United States Patent [19]

Meyer

[11] 4,193,548

[45] Mar. 18, 1980

[54] HIGH CAPACITY SPRINKLER HEAD WITH IMPROVED BRAKE MECHANISM

[75] Inventor: Larry P. Meyer, Walla Walla, Wash.

[73] Assignee: Nelson Irrigation Corporation, Walla Walla, Wash.

[21] Appl. No.: 952,608

[22] Filed: Oct. 18, 1978

[51] Int. Cl.[2] ..... B05B 3/02; B05B 3/14

[52] U.S. Cl. ..... 239/230; 188/83; 188/166; 239/252

[58] Field of Search ..... 239/230–233, 239/241, 252; 188/83, 166

[56] References Cited

U.S. PATENT DOCUMENTS

| | | | |
|---|---|---|---|
| 2,649,268 | 8/1953 | Stein | 239/230 |
| 3,559,887 | 2/1971 | Meyer | 239/233 |
| 3,580,507 | 5/1971 | Beamer | 239/233 |
| 3,592,388 | 7/1971 | Friedlander | 239/233 |
| 3,623,666 | 11/1971 | Meyer | 239/233 X |
| 3,744,720 | 7/1973 | Meyer | 239/231 |
| 3,986,671 | 10/1976 | Nugent | 239/230 |

*Primary Examiner*—Robert B. Reeves
*Assistant Examiner*—Andres Kashnikow
*Attorney, Agent, or Firm*—Cushman, Darby & Cushman

[57] ABSTRACT

A step-by-step rotary sprinkler head comprising a stationary annular housing assembly, an annular mounting member supported within the upper end portion of the stationary annular housing for rotational movement about a generally vertically extending axis generally coextensive with the annular axis of the housing assembly. The mounting member has three sets of equally annularly spaced holes extending vertically therethrough. An annular brake member has a set of equally annularly spaced stub shafts extending vertically upwardly therefrom which slidably engage within one set of holes. The annular brake member has a downwardly facing annular brake surface thereon which engages a fixed upwardly facing annular brake surface provided by the housing assembly. A sprinkler body assembly is carried by the mounting member and is fixedly secured thereto by bolts extending therethrough and threadedly engaged within another one of the sets of holes. A series of coil springs is mounted within a third one of the sets of holes to resiliently urge the interengaging brake surfaces together with a constant spring force.

11 Claims, 5 Drawing Figures

HIGH CAPACITY SPRINKLER HEAD WITH IMPROVED BRAKE MECHANISM

This invention relates to sprinklers and more particularly to step-by-step rotary sprinkler heads of the high capacity type.

Sprinkler heads of the high capacity type herein contemplated are disclosed in the following U.S. Pat. Nos. 2,649,268; 3,559,887; 3,580,507; 3,592,388; 3,623,666; 3,744,720; and 3,986,671. It is characteristic of all of these sprinkler heads that they include a stationary annular housing which is adapted to be fixed into communicating relation with a source of water under pressure and a rotating sprinkler body assembly mounted on the stationary housing assembly for rotational movement about a generally vertically extending axis. Most of these high capacity sprinklers utilize an impulse arm to effect a step-by-step rotational movement of the sprinkler body assembly with respect to the stationary housing assembly. The extent of each rotational step-by-step movement is controlled by a brake mechanism acting between the rotating assembly and the stationary assembly. In some of the patents noted above an adjustable band type brake is provided, while in others adjustable disc type brakes are provided.

With the advent of non-adjustable pressure compensating impulse arm mechanisms such as disclosed in U.S. Pat. No. 3,559,887 which served to provide a generally constant impulse force throughout a wide range of pressure conditions, the need to provide the adjustment for the brake force provided by the brake mechanism has been minimized. Indeed, experience has shown that where the ability to effect adjustment is provided in an impulse sprinkler head of the high capacity type, inevitably the adjusting mechanism will provide a source of malfunction. This is due primarily to the high impact forces to which the sprinkler head is subjected and improper adjustments by the user of the sprinkler. Accordingly, it is desirable to provide a brake mechanism for a step-by-step sprinkler head of the type described which is non-adjustable and of sufficient structural simplicity and reliability as to provide for a constant non-adjustable braking force useful throughout the life of the sprinkler head.

An object of the present invention is to provide a sprinkler head of the type described which satisfies the above-noted desirable criteria. In accordance with the principles of the present invention, this objective is obtained by providing an annular mounting member within the stationary annular housing which is supported therein for rotational movement about a generally fixed vertical axis coincident with the annular axis of the housing assembly. The annular mounting member is formed with three sets of equally annularly spaced holes. An annular brake member is provided which includes at least three upwardly extending lugs which are slidably mounted within one set of holes. The sprinkler body is carried by the mounting member and fixedly secured thereto by at least three bolts which are threadedly engaged within a second set of the holes. Finally, at least three coil springs are mounted in the third set of holes with their lower ends in engagement with the brake member to resiliently urge the latter downwardly so that an annular downwardly facing brake surface thereon will engage an upwardly facing brake surface fixed to the stationary housing assembly with a constant spring force. This arrangement provides for the simple assembly and maintenance of the brake assembly in a manner which is effective over a long period of use.

The invention is further characterized by the utilization of a stacked arrangement of housing sections, seals and bearings for mounting the barrel portion of the sprinkler head for rotational movement about a vertical axis which rotational movement is controlled by the brake mechanism.

These and other objects of the present invention will become more apparent during the course of the following detailed description and appended claims.

The invention may best be understood with reference to the accompanying drawings, wherein an illustrative embodiment is shown.

Figure 1:
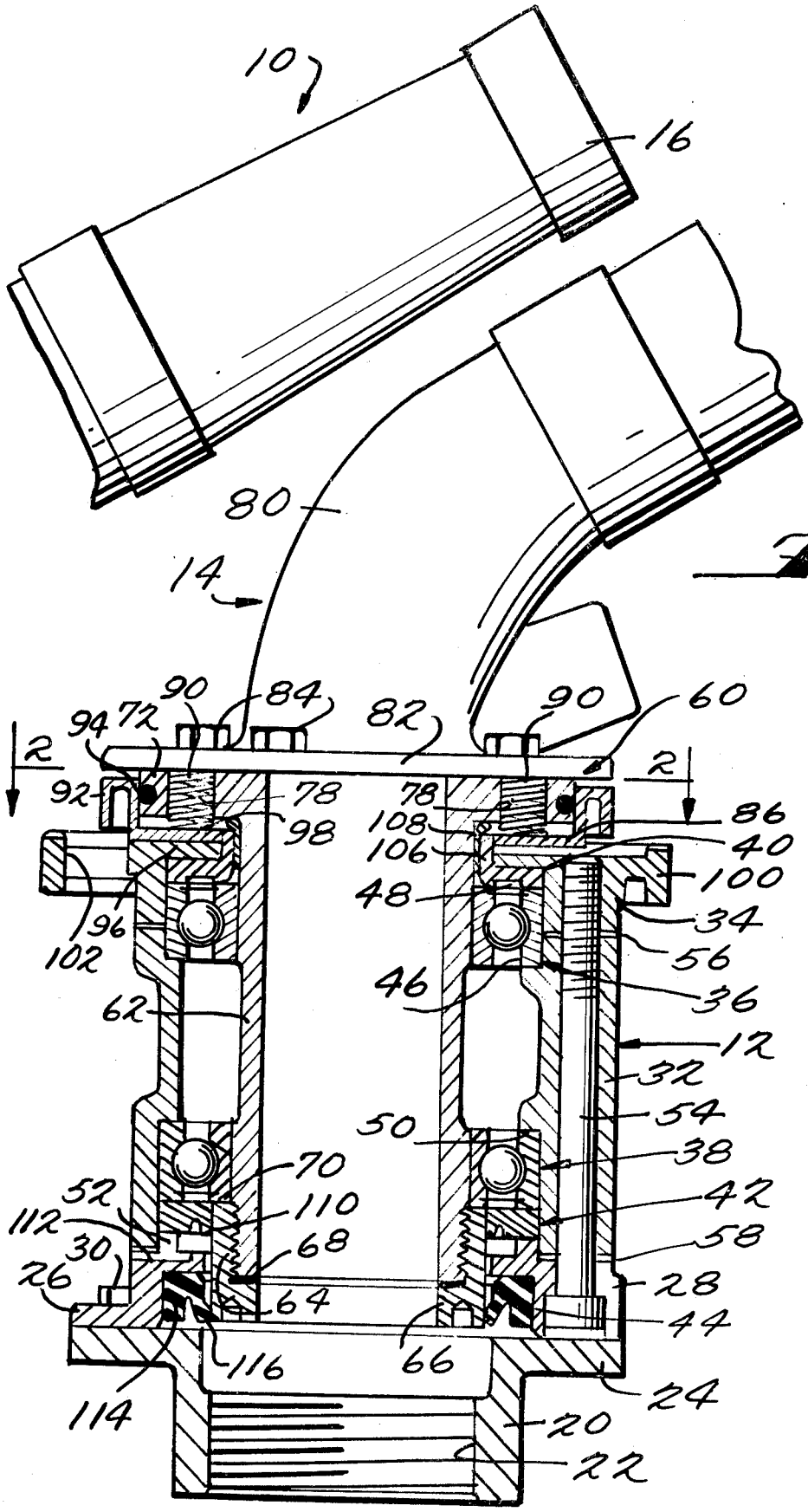
FIG. 1 is a side elevational view of a portion of a sprinkler head embodying the principles of the present invention with certain parts shown in vertical section.

Referring now more particularly to the drawings, there is shown therein a sprinkler head, generally indicated at 10, which embodies the principles of the present invention. The sprinkler head 10 includes a stationary annular housing assembly, generally indicated at 12, which is adapted to be fixedly mounted at its lower portion on a source pipe or the like (not shown) containing a source of water under pressure. Mounted within the annular housing assembly 12 for rotational movement about a fixed vertical axis coincident with the annular axis of the housing 12, is a rotating sprinkler body assembly, generally indicated at 14. It will be understood that the upper barrel portion of the sprinkler body 14 extends generally upwardly and outwardly with respect to the axis of rotation and terminates in a discharge nozzle 16 which serves to direct the source of water under pressure connected with the stationary housing assembly 12 upwardly and outwardly. In accordance with conventional practice, an impulse arm assembly (not shown) is mounted on the upper barrel portion of the sprinkler body assembly 14 for imparting successive impulse forces on the sprinkler body acting in a direction tangential to the axis of rotation so as to impart a step-by-step rotary movement to the sprinkler body assembly 14. The extent of the step-by-step rotary movement is determined by a brake mechanism, generally indicated at 18, which is constructed in accordance with the principles of the present invention.

It will be understood that the present invention is applicable to full circle sprinkler heads as well as part circle sprinkler heads. For present purposes it is believed sufficient to refer to the impules arm mechanisms and part circle reversing mechanisms disclosed in commonly owned U.S. Pat. Nos. 3,559,887; 3,623,666; and 3,744,720, rather than to include a detailed description herein. Accordingly, the disclosures of these patents are hereby incorporated by reference into the present specification. It is not felt necessary to illustrate these components of the sprinkler head 10 since the invention is more concerned with the construction and operation of the brake mechanism 18 and the cooperation of the components thereof with the interrelated components of the stationary housing assembly 12 and sprinkler body assembly 14.

Figure 2:
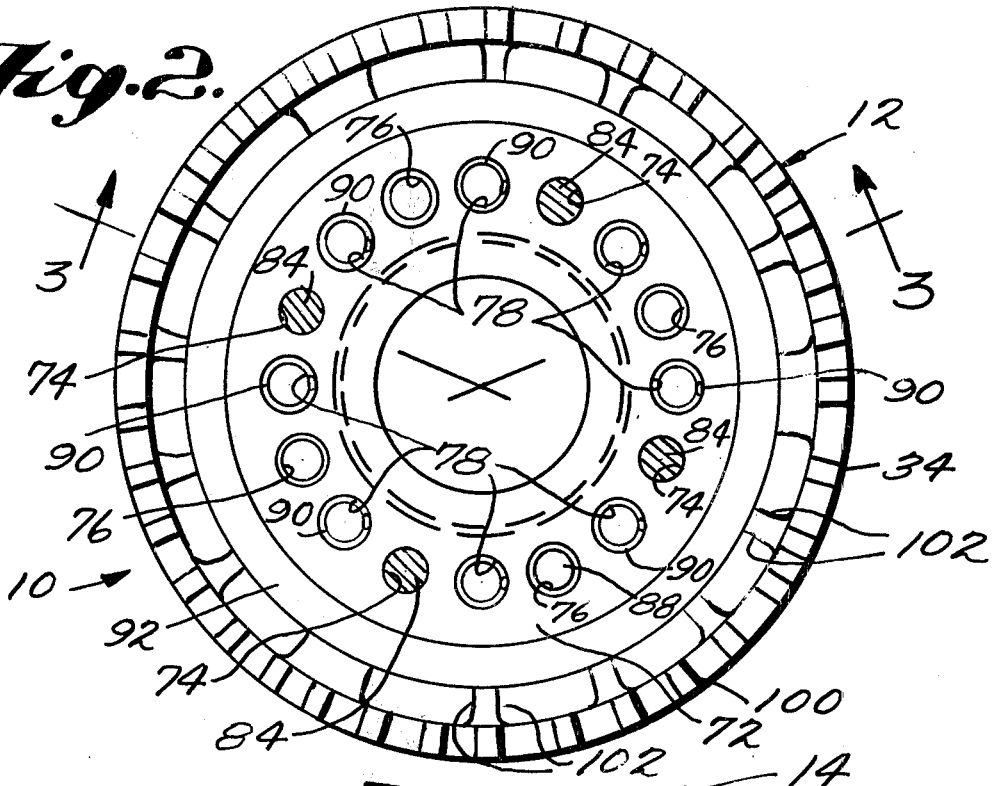
FIG. 2 is a cross-sectional view taken along the line 2—2 of FIG. 1.
Figure 3:
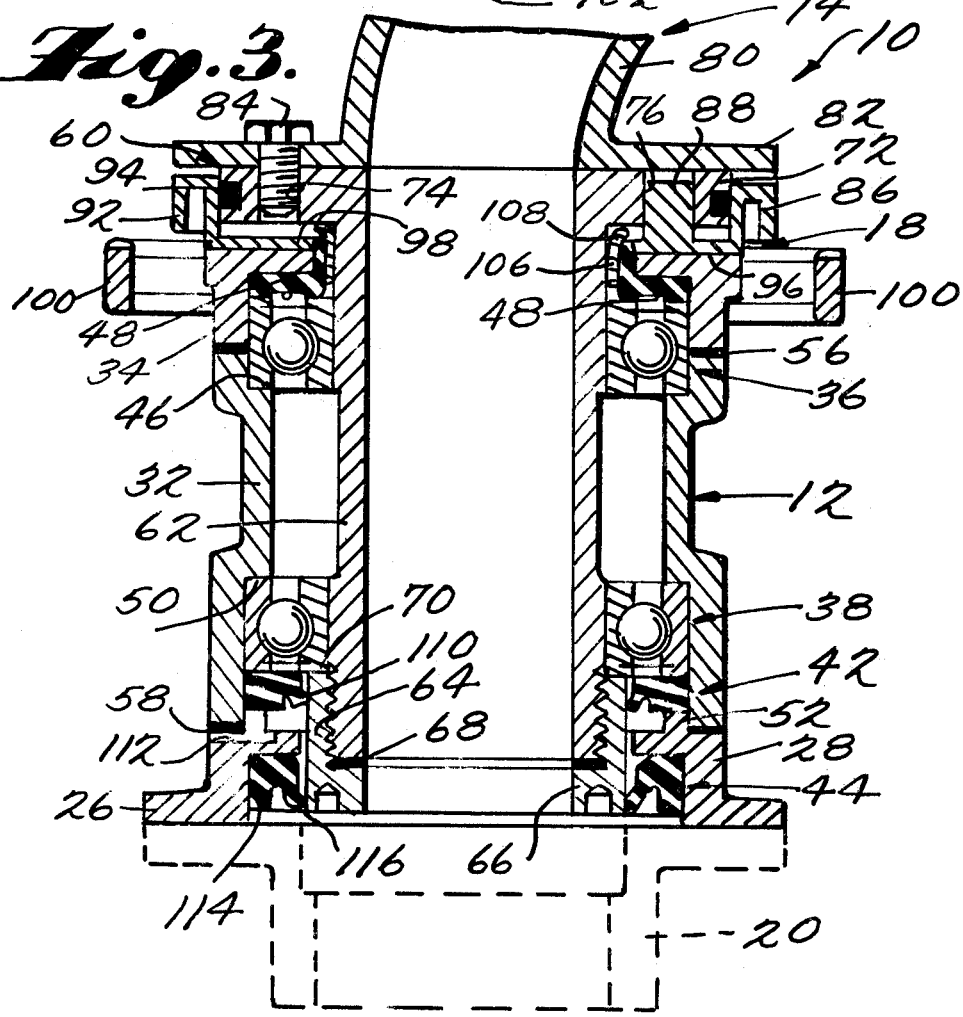
FIG. 3 is a sectional view taken along the line 3—3 of FIG. 2.

Referring now more particularly to FIGS. 1–3, the stationary annular housing assembly 12 includes a lower annular adapter housing member 20 having interior threads 22 arranged to be threadedly engaged on the upper end of a source pipe (not shown) which carries a source of water under pressure. The adapter member 20 includes an upper radially outwardly extending annular flange 24 which is adapted to be rigidly connected with an annular flange 26 of a lower housing section 28, as by a series of annularly spaced bolts 30. The lower housing section 28 forms a part of a three layered or stacked housing sub-assembly which also includes a central annular housing section 32 and an upper annular housing section 34. The layered or stacked construction of the stationary housing sub-assembly serves to mount in operative relation therewithin a pair of upper and lower ball bearing assemblies 36 and 38 respectively, and a pair of upper and lower annular seals 40 and 42 respectively. A third lower seal 44 is also provided.

As shown, the ball bearing assemblies 36 and 38 and the annular seals 40 and 42 enter into a cooperative layered or stacked relation with the housing sections 28, 32 and 34 along the interior periphery of the latter. To this end, the intermediate housing section 32 has a bore formed in the upper end thereof which defines an upwardly facing annular shoulder 46 for receiving the lower surface of the outer race of the ball bearing assembly 36. The upper surface of the outer race of the ball bearing assembly 36 is engaged by the lower annular surface of the annular seal 40. The upper housing section 34 has an upwardly extending bore therein which defines a downwardly facing annular shoulder 48 engaged by the upper surface of the annular seal 40.

In a similar manner, the lower end of the intermediate housing section 32 has a bore extending upwardly therein which defines a downwardly facing annular shoulder 50 engaged by the upper surface of the outer race of the lower bearing assembly 38. The lower surface of the outer race of the bearing assembly 38 is engaged by the upper surface of the lower annular seal 42. The lower surface of the annular seal 42 is engaged by the upper surface of an annular projection 52 extending from the upper end of the lower housing section 28.

The housing sections 28, 32 and 34 are provided with a series of three annularly spaced aligned openings for receiving a series of three bolts 54 which serve to tighten the layered or stacked sub-assembly together with sealing gaskets 56 and 58 between the sections thereof. It can be seen that tightening of the bolts 54 has the effect of not only securing the layered or stacked housing sections together, but also of mounting in operative relation on the interior of the stationary housing sections the upper and lower bearing assemblies 36 and 38 as well as upper and lower seals 40 and 42.

In accordance with the principles of the present invention, the rotary sprinkler body assembly 14 includes an annular mounting member, generally indicated at 60, which provides a unique cooperating relationship between the stationary housing assembly 12, the adjacent components of the rotating sprinkler body assembly 14 and the brake mechanism 18. The mounting member 60 includes a sleeve portion 62 having its exterior periphery shaped to engage the inner race of both the upper bearing assembly 36 and the lower bearing assembly 38. It will be noted that the lower extremity of the sleeve portion 62 extends downwardly below the connection of the exterior periphery thereof with the lower ball bearing assembly 38. This lower extremity is exteriorly threaded, as indicated at 64, to threadedly receive a nut-like sleeve member 66. The sleeve 66 includes an inner flange on the lower end thereof which, by means of a gasket 68, sealingly engages the lower end edge of the sleeve portion 62. The upper end edge of the sleeve 66 engages the lower surface of the inner race of the bearing assembly 38, as indicated at 70. The arrangement of the sleeve 66 is such that when water under pressure is communicated with the sprinkler body assembly 14 so as to create an upward thrust force on the sprinkler body assembly, the engagement of the member 66 serves to transmit this force to bearing assembly 38.

The mounting member 60 also includes a flange portion 72 extending radially outwardly from the upper end of the sleeve portion 62. As best shown in FIG. 2, the flange portion 72 has formed therein a first set of four equally annularly spaced holes 74, a second set of four equally annularly spaced holes 76 displaced 45° from the holes 74, and a third set of eight equally annularly spaced holes 78, each of which is spaced between adjacent holes 74 and 76. As best shown in FIG. 2, preferably each of the holes 74, 76 and 78 extends vertically completely through the flange portion 72 of the mounting member 60 and has its axis disposed within a cylindrical plane having its axis coincident with the axis of rotation of the sprinkler body assembly 14.

The sprinkler body assembly 14 includes a lower elbow member 80 which has an annular flange 82 on its lower end portion of a diameter size greater than the diameter size of the flange portion 72 of the mounting member 60. The flange 82 is mounted on the flange portion 72 in supported relation thereon. The elbow member 80 is fixedly secured to the mounting member 60 in the aforesaid supported relationship by four bolts 84 extending through appropriate openings in the flange 82 and threadedly engaged within the interiorly threaded periphery of the first set of four holes 74 in the flange portion 72.

The braking mechanism 18 includes an annular brake member 86 mounted below the flange portion 72. The brake member 86 has four equally annularly spaced stub shafts 88 extending upwardly therefrom which are disposed in sliding engagement within the second set of four holes 76 in the flange portion 72. In this way, the annular brake member 86 is mounted for rotational movement with the rotating sprinkler body assembly 14 and for relative vertical movement with respect thereto. Mounted within the third set of eight remaining holes 78 are eight coil springs 90.

As best shown in FIG. 1, the upper ends of the coil springs 90 engage the lower surface of the elbow flange 82 while the lower ends thereof engage the upper surface of the annular brake member 86. In this regard, it will be noted that the annular brake member 86 includes an inverted U-shaped annular flange 92 extending upwardly from the outer periphery thereof in surrounding relation with the exterior periphery of the flange portion 72 of the mounting member 60. Preferably, an O-ring seal 94 is mounted within an appropriate annular groove formed in the exterior periphery of the flange portion 72 so as to engage the interior periphery of the annular flange 92 of the brake member 86.

It will be noted that the annular brake member 86 is formed with a downwardly facing brake surface 96 which is disposed in engagement with an upwardly facing brake surface 98 formed on the central annular portion of the upper housing section 34. The upper housing section 34 is also formed with an exterior annular flange 100 of T-shaped cross-sectional configuration extending radially outwardly from the central portion thereof. The cross portion of the T-shaped flange serves as a means for adjustably mounting cam members (not shown) forming a part of the reversing mechanism of a part-circle sprinkler head. Notchings are provided on the upper surface, as shown, as an aid in positioning the cam members.

Figure 4:
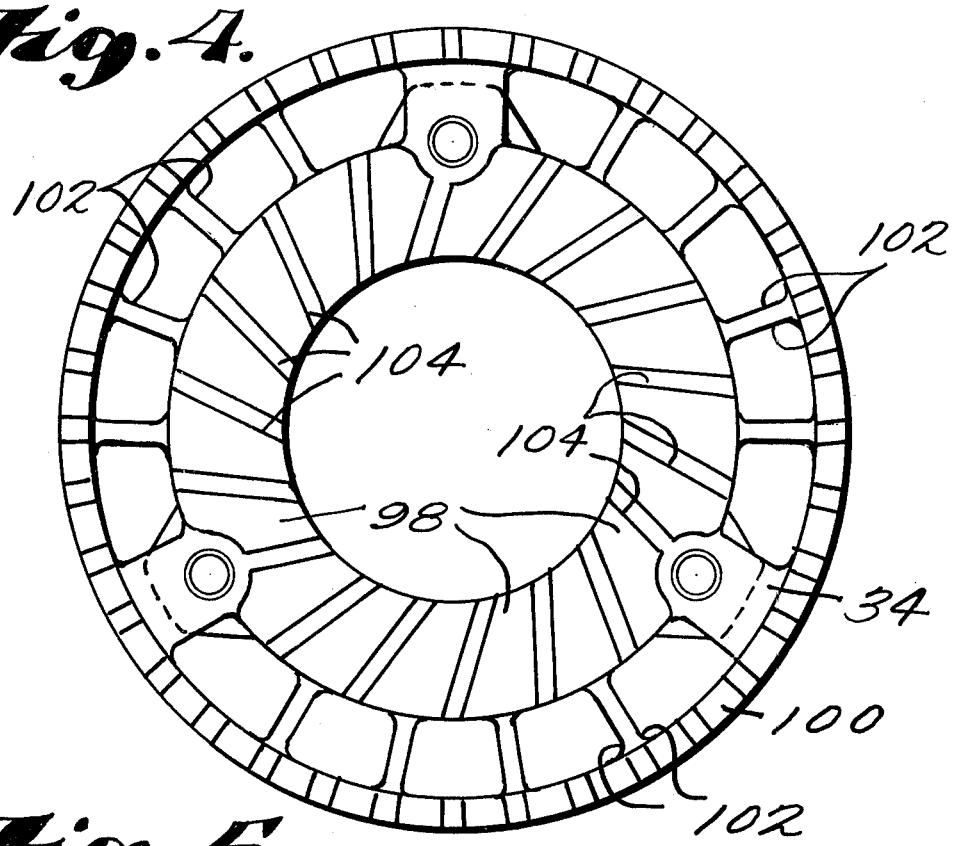
FIG. 4 is a top plan view of the upper housing member of the sprinkler head.
Figure 5:
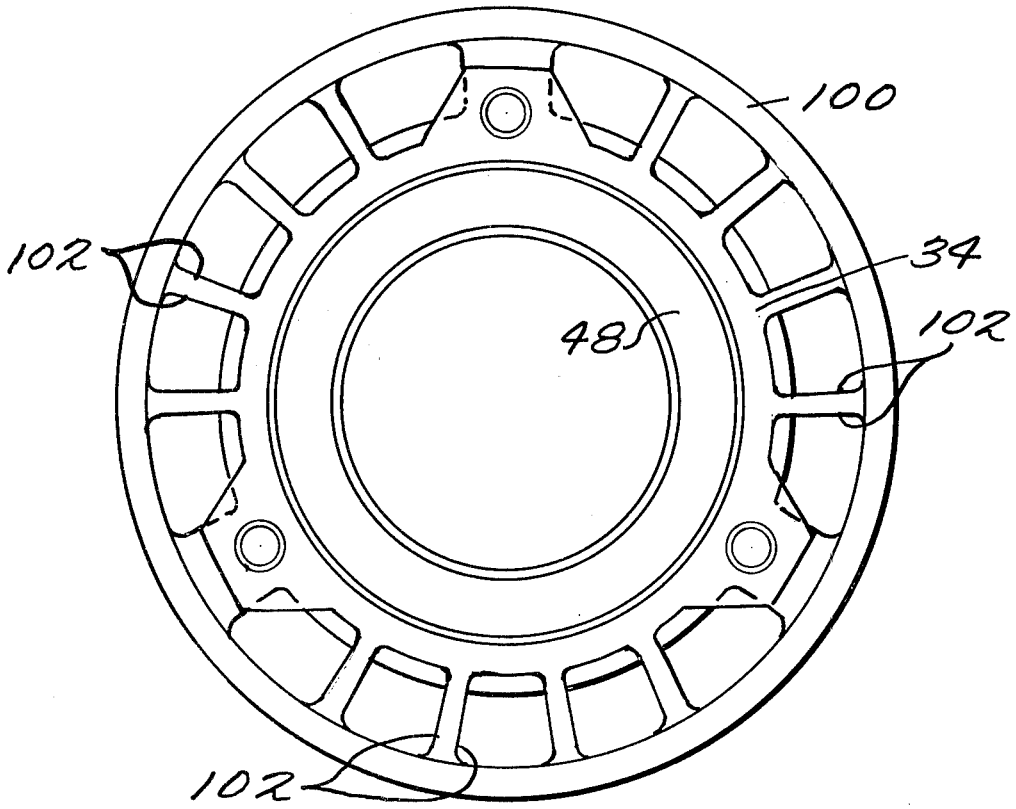
FIG. 5 is a bottom plan view of the structure shown in FIG. 4.

As best shown in FIG. 4, the horizontally extending stem portion of the T-shaped flange 94 has a series of drain openings 102 extending vertically therethrough. In addition, there is formed in the upwardly facing brake surface 98 of the housing section 34 a series of drain recesses or grooves 104 which extend from the interior periphery of the housing section 34 to an associated drain opening 104. It can thus be seen that whereas O-ring seal 94 serves to prevent the flow of moisture between the flange portion 72 of the mounting member 60 and the brake member 86, any moisture which tends to accumulate between the brake member 86 and the housing member 34 will pass into the drain grooves 104 and then downwardly through the drain openings 102. An additional purpose is to provide an escape path for wear particles so that a constant coefficient of friction is maintained by the brake. The upper seal 40 is formed with an upwardly extending sealing lip 106, which engages the inner periphery of both the housing section 34 and the brake member 86. A metallic sealing ring 108 is provided on the exterior periphery of the sleeve portion 62 in engagement below the flange portion 72 of the mounting member so as to engage the interior periphery of the sealing lip.

The upper ball bearing assembly 36 preferably has, in addition to the above, a built-in upper seal which provides further sealing protection for the interior rolling parts. The annular space between the interior periphery of the intermediate housing section 32 and the exterior periphery of the sleeve portion 62 of the mounting member 60 defined by the upper and lower bearing assemblies 36 and 38 constitutes a lubrication well within which a lubricant such as grease or the like is packed. In this regard, it will be noted that the lower ball bearing assembly 38 is preferably provided with a lower self-contained seal and that the lower seal 42 is provided with a downwardly and inwardly extending sealing lip 110 which sealingly engages the cylindrical exterior periphery of the sleeve 66.

It will also be noted that the lower housing section 28 has a series of annularly spaced drain grooves 112 formed in the upper periphery thereof which provide outlet channels for the discharge of any excess moisture or water which may come into engagement with the lower surface of the seal 42. Seal 44 is disposed within an upper bore 114 formed in the lower housing section 28 and has a downwardly and inwardly extending sealing lip 116 disposed in sealing engagement with this lower exterior periphery of the sleeve 66. The seal 44 provides the primary seal for the water under pressure communicated with the interior of the sprinkler body assembly 14 through the adapter housing member 20. Any seepage of water upwardly past the seal 40 is prevented from entering into the ball bearing assembly 38 by virtue of the lower annular seal 42 and the built-in seal of the assembly itself. As previously indicated, any seepage which may get past the primary seal 44 is allowed to drain through the outlet openings 112.

The above-described construction provides for simplification of initial assembly and dis-assembly for maintenance, if such maintenance should ever become necessary. One mode of assembly is to invert the member 60 and then to simply stack up the other components thereon until the entire housing sub-assembly is interconnected by bolts 54 and the mounting member is secured in place by locking sleeve 66. The sub-assembly is then inverted and adapter housing member 20 is fixed to the lower end of the sub-assembly by bolts 30. After engaging springs 90 in the opening 78, elbow 80 can then be assembled above the flange portion 72 of the mounting member 60 by engaging bolts 84 within the openings 74 thereof.

Once assembled, the arrangement is such that the springs 90 provide a constant force urging the brake member 86 downwardly so that its downwardly facing brake surface 96 engages the upwardly facing brake surface 98 of the housing section 34 and provides a constant frictional force resisting the rotational movement of the sprinkler body assembly 14. The arrangement is such that the spaced upper and lower bearing assemblies are completely sealed from the interior water pressure as well as exterior moisture. The drain grooves 104 and drain openings 102 provide for adequate drainage of any moisture which may tend to enter between the cooperating braking surfaces of the brake mechanism.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A step-by-step rotary sprinkler head comprising:

a stationary annular housing assembly having a lower portion adapted to be fixedly connected in communicating relation with respect to a source of water under pressure, an annular mounting member supported within the upper end portion of said stationary annular housing for rotational movement about a generally vertically extending axis generally coextensive with the annular axis of said housing assembly, said mounting member having a first set of at least three equally annularly spaced threaded stud receiving holes extending vertically therein, a second set of at least three equally annularly spaced stub shaft receiving holes extending vertically therein and a third set of at least three equally annularly spaced coil spring receiving holes extending vertically therein, an annular brake member having at least three equally annularly spaced stub shafts extending vertically upwardly therefrom and slidably mounted within said second set of holes, said annular brake member having a downwardly facing annular brake surface thereon, means in the upper portion of said stationary housing assembly providing a fixed upwardly facing annular brake surface disposed in engaged relation with said downwardly facing annular brake surface, a sprinkler body assembly carried by said mounting member and fixedly secured thereto by bolts extending therethrough and threadedly engaged within said first set of holes, at least three equally annularly spaced coil springs mounted within said third set of holes having their lower ends engaged with said annular brake member so as to resiliently urge the downwardly facing brake surface thereof into engaged relation with said upwardly facing brake surface with a constant spring force, and means for communicating said sprinkler body assembly with said stationary housing assembly in fluid-tight communicating relation therewith.

2. A step-by-step rotary sprinkler head as defined in claim 1 wherein each of said set of holes extends vertically completely through said mounting member.

3. A step-by-step rotary sprinkler head as defined in claim 1 wherein the vertical axis of the holes of each of said first, second and third sets of holes lies in a cylindrical plane having its axis coincident with said fixed axis of rotation.

4. A step-by-step rotary sprinkler head as defined in claim 1, 2 or 3 wherein there are four holes in said first set of holes, four holes in said second set of holes displaced 45° from the first set of holes, and eight holes in said third set of holes each one of which is spaced between a hole of said first set and a hole of said second set.

5. A step-by-step rotary sprinkler head as defined in claim 1 wherein said annular brake member includes an annular flange extending upward from the outer periphery thereof and having its interior periphery slidably sealingly connected with the exterior periphery of said mounting member.

6. A step-by-step rotary sprinkler head as defined in claim 1, 2, 3 or 5 wherein said stationary annular housing assembly includes an upper housing section having a central annular portion, said means providing said upwardly facing annular brake surface comprising the upper surface of the central annular portion of said upper housing section.

7. A step-by-step rotary sprinkler head as defined in claim 6 wherein the central portion of said upper housing section is formed with a T-shaped annular flange extending outwardly therefrom, the stem portion of said T-shaped flange having a plurality of openings extending vertically therethrough.

8. A step-by-step rotary sprinkler head as defined in claim 7 wherein the upper surface of the central portion of said upper housing section is formed with a plurality of grooves leading from the interior periphery thereof to said plurality of openings.

9. A step-by-step rotary sprinkler head as defined in claim 6 wherein said housing assembly includes an intermediate housing section and a lower housing section disposed in stacked relation to said upper housing section, an upper annular seal and an upper bearing assembly disposed in stacked relation between the upper and intermediate housing sections, a lower bearing assembly and a lower annular seal disposed in stacked relation between the intermediate and lower housing sections, said mounting member having a sleeve portion extending through said upper annular seal, said upper bearing assembly, said lower bearing assembly and said lower annular seal with the exterior periphery thereof disposed in cooperating relation therewith.

10. A step-by-step rotary sprinkler head as defined in claim 9 wherein the sleeve portion of said housing member has a sleeve nut threaded on the lower exterior periphery thereof engaging the lower bearing assembly.

11. A step-by-step rotary sprinkler head as defined in claim 10 wherein said lower housing section includes an upwardly extending bore in the lower portion thereof having a third annular seal therein provided with a sealing lip engaging the exterior periphery of said sleeve nut.

* * * * *